United States Patent [19]

Muller et al.

[11] 4,266,027

[45] May 5, 1981

[54] PROCESS FOR THE HYDROLYSIS OF STARCH AND FERMENTABLE HYDROLYSATES OBTAINED THEREFROM

[75] Inventors: Werner C. Muller, Dobbs Ferry, N.Y.; Franklyn D. Miller, Cincinnati, Ohio

[73] Assignee: National Distillers and Chemical Corp., New York, N.Y.

[21] Appl. No.: 129,517

[22] Filed: Mar. 12, 1980

[51] Int. Cl.[3] ..... C13K 1/06

[52] U.S. Cl. ..... 435/99; 127/38; 127/46 A; 127/70

[58] Field of Search ..... 127/38, 39, 46 A, 70, 127/71; 435/99

[56] References Cited

U.S. PATENT DOCUMENTS

| | | | |
|---|---|---|---|
| 2,606,847 | 8/1952 | Newkirk | 127/46 A X |
| 2,770,562 | 11/1956 | Fetzer | 127/38 X |
| 3,383,245 | 5/1968 | Scallet | 127/38 X |
| 3,592,734 | 7/1971 | Kroyer | 435/99 X |
| 3,616,219 | 10/1971 | Massey | 435/99 |
| 3,690,948 | 9/1972 | Katz | 127/46 A |
| 3,912,590 | 10/1975 | Slott | 435/99 |
| 3,922,196 | 11/1975 | Leach | 435/99 X |
| 3,922,199 | 11/1975 | Hebeda | 435/99 |

*Primary Examiner*—Sidney Marantz

*Attorney, Agent, or Firm*—Kenneth D. Tremain

[57] ABSTRACT

An aqueous starch slurry is initially hydrolyzed in the presence of acid or enzyme and thereafter, the liquefied starch is saccharified in the presence of an acid cationic exchange resin to provide a sterile aqueous solution containing at least about 60 weight percent fermentable sugar based on the weight of the original starch present.

17 Claims, 1 Drawing Figure

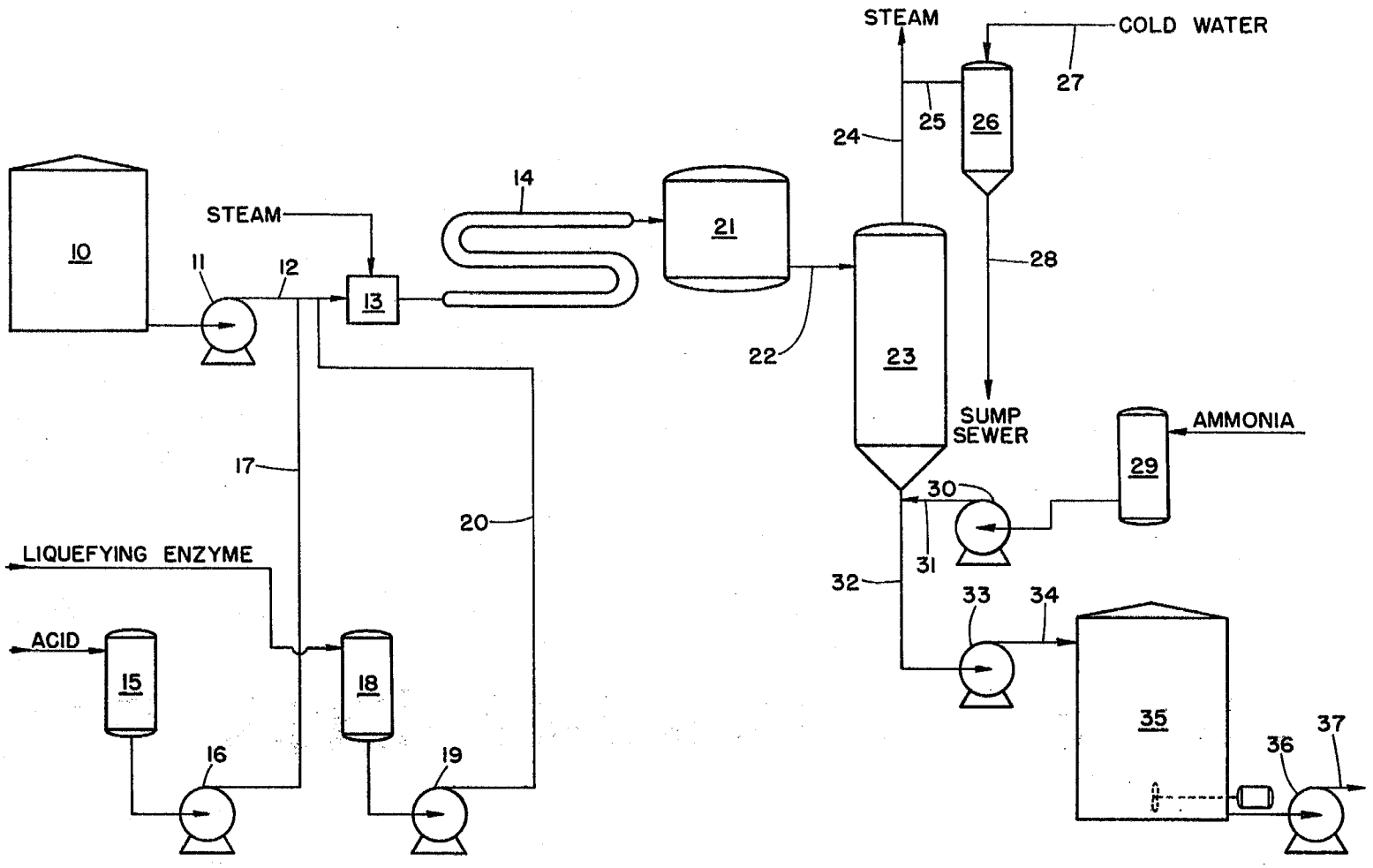
COLD WATER
27
26
28
SUMP SEWER
STEAM
25
24
23
AMMONIA
29
30
31
32
33
34
35
36
37
22
21
14
20
19
18
13
STEAM
12
11
10
17
LIQUEFYING ENZYME
16
15
ACID

PROCESS FOR THE HYDROLYSIS OF STARCH AND FERMENTABLE HYDROLYSATES OBTAINED THEREFROM

BACKGROUND OF THE INVENTION

1. Field of the Invention

This invention relates to processes for hydrolyzing starches and more particularly, to such processes especially adapted to provide substrate sugars for the fermentation of ethanol.

2. Description of the Prior Art

With the ever-increasing depletion of economically recoverable petroleum reserves, the production of ethanol from vegetative sources as a partial or complete replacement for conventional fossil-based liquid fuels becomes more attractive. In some areas, the economic and technical feasibility of using a 90% unleaded gasoline-10% anhydrous ethanol blend ("gasohol") has shown encouraging results. According to a recent study, gasohol powered automobiles have averaged a 5% reduction in fuel compared to unleaded gasoline powered vehicles and have emitted one-third less carbon monoxide than the latter. In addition to offering promise as a practical and efficient fuel, biomass-derived ethanol in large quantities and at a competitive price has the potential in some areas for replacing certain petroleum-based chemical feedstocks. Thus, for example, ethanol can be catalytically dehydrated to ethylene, one of the most important of all chemical raw materials both in terms of quantity and versatility.

The various operations in processes for obtaining ethanol from such recurring sources as cellulose, cane sugar, amylaceous grains and tubers, e.g., the separation of starch granules from non-carbohydrate plant matter and other extraneous substances, the chemical and/or enzymatic hydrolysis of starch to fermentable sugar (liquefaction and saccharification), the fermentation of sugar to a dilute solution of ethanol ("beer") and the recovery of anhydrous ethanol by distillation, have been modified in numerous ways to achieve improvements in product yield, production rates and so forth. For ethanol to realize its vast potential as a partial or total substitute for petroleum fuels or as a substitute chemical feedstock, it is necessary that the manufacturing process be as efficient as possible so as to maximize the amount of ethanol produced and enhance the standing of the ethanol as an economically viable replacement for petroleum based raw materials. To date, however, relatively little concern has been given to optimizing the large scale manufacture of ethanol form biomass.

The substitution of alcohol for at least a portion of petroleum based fuels is particularly critical for developing economies where proven domestic petroleum reserves are limited, such as in India and Brazil, and these nations have therefore increasingly emphasized the production of alcohol from vegatative sources, especially from starch-containing grains and tubers.

To make starch an economically attractive source of ethanol, it is essential to achieve rapid and high levels of conversion of the starch to fermentable saccharide and of the fermentable saccharide to ethanol while minimizing consumption of raw materials.

Processes for the acid hydrolysis of starch to provide fermentable saccharides are known (viz., the acid starch hydrolysis processes described in U.S. Pat. Nos. 2,203,325; 2,210,659; 2,359,763; 2,393,095; 2,395,907; 2,565,404; 2,946,706; 2,954,304; 2,989,425; 3,169,083; 3,200,012; 3,236,687; 3,313,654; 3,446,664; 3,484,287; 3,607,395; and, 4,137,094). It is also known from U.S. Pat. No. 2,529,131 to subject still bottoms, or "vinasse", containing unfermented sugars to acid hydrolysis to convert said sugars to fermentable substrate. In all of the afore-said acid hydrolysis processes, prior to conversion of the aqueous fermentable hydrolysate to ethanol employing yeast, the hydrolyzing acid must be neutralized with base. This results in the presence of relatively substantial quantities of salt in the fermentation feed, a condition which is decidedly disadvantageous for optimum ethanol production. And since the salts serve no useful function for any of the discrete operations involved in the conversion of starch to ethanol, their presence as by-products in the sugar liquor merely represents a wasteful consumption of raw materials, i.e., acid and neutralizing base.

Processes for the enzymatic hydrolysis of starch to provide fermentable saccharides are also well known (viz., U.S. Pat. Nos. 2,219,668; 2,289,808; 2,356,218; 2,431,004; 2,676,905; 2,954,304; 3,308,037; 3,337,414; 3,423,239; 3,425,909; 3,551,293; 3,565,764; 3,592,734; 3,654,081; 3,720,583; 3,910,820; 3,912,590; 3,922,196; 3,922,197; 3,922,198; 3,922,199; 3,922,200; 3,922,201; 3,969,538; 3,988,204; 3,922,261; 3,966,107; 3,969,538; 3,998,696; 4,014,743; 4,016,038; 4,017,363; 4,028,186; and 4,032,403; see also, Novo Industri A/S (DK-2880 Bagsvaerd, Denmark) brochures entitled "Dextrose and Starch Sugar", "Conversion of Starch" and "Glucose Syrup").

While the enzyme hydrolysis of starch generally provides sugar which is of a superior quality compared to that obtained by acid hydrolysis, the somewhat longer conversion times and the relatively high cost of enzymes tend to militate against the use of enzyme hydrolysis methods where maximum rates and levels of sugar production, not product quality, is of foremost consideration.

Accordingly, there has heretofore existed a need for a process for hydrolyzing an aqueous starch slurry to a solution of fermentable sugar starch at rapid and high levels of conversion while dispensing with or minimizing the need to neutralize acid present in the sugar solution.

SUMMARY OF THE INVENTION

In accordance with the present invention, an aqueous slurry of starch is first liquefied, i.e., converted to a pumpable partial hydrolysate, employing a liquefying agent selected from the group consisting of strong acid and liquefying enzyme and the partial hydrolysate is thereafter saccharified in the presence of an acidic cationic exchange resin to provide an aqueous solution of fermentable sugar containing little free acid. Any amount of acid which may be present is of a relatively low level of magnitude and its neutralization with base will result in the production of but a correspondingly small amount of salt.

Neutralizing any acid which may be present in the sugar liquor with ammonia provides an ammonium salt which is retained in the sugar liquor and serves to satisfy part of the nutritive requirements of the yeast employed in the fermentation of the sugar liquor to ethanol. Accordingly such neutralization constitutes a preferred embodiment of the present invention. Among the sources of starch to which the process herein is applicable are included cassava (manioc), taro, corn, sorghum, wheat, potatoes, rice, milo, and the like.

The term "strong acid" as employed herein refers to any of the inorganic acids having a pKa value of at least about 2.5 or less. The term "fermentable sugar" should be understood as referring to a single fermentable sugar such as glucose (dextrose), fructose, maltose or sucrose but more commonly will be applicable to these and similar fermentable saccharides in admixture.

BRIEF DESCRIPTION OF THE DRAWING

The accompanying drawing is a diagrammatic flow sheet illustrative of one embodiment of a starch hydrolysis process in accordance with the present invention.

DESCRIPTION OF THE PREFERRED EMBODIMENTS

Referring to the drawing, a concentrated aqueous slurry of starch which contains from about 20 to about 50 weight percent dry substance (D.S.), and preferably from about 30 to about 40 weight percent D.S., and which may also contain other materials reflecting the source from which the starch was obtained such as water soluble proteins, fats, sugars and minerals and/or water insoluble materials such as fiber, minute amounts of soil, gravel, etc., is delivered from starch slurry tank 10 by pump 11 through line 12 to steam jet mixer 13 where it is combined with steam and thereafter passed through starch liquefier 14. Pump 11 provides a discharge pressure which is substantially greater than the saturation pressure of steam at the temperature to which the slurry is heated in starch liquefier 14. Prior to introduction into steam jet mixer 13, the starch slurry is combined with a strong acid as partial, but preferably, exclusive, liquefying agent to provide a pH of from about 1.0 to about 2.5, and preferably from about 1.2 to 2.2. Suitable acids include nitric acid, sulfuric acid, hydrochloric acid and phosphoric acid. The acid is supplied from storage vessel 15 where it is moved by pump 16 through line 17 to be mixed with the starch slurry passing through line 12. When employing acids as the liquefying agent, the amount of steam introduced into the starch slurry through steam jet mixer 13 is sufficient to provide a temperature in starch liquefier 14 which is in the range of from about 160° F. to about 350° F., in which range the pressure of the steam can vary from about 25 psig to about 250 psig. Preferably, starch liquefier 14 is operated within the range of from about 200° F. to about 250° F. and at a pressure of from about 50 to about 150 psig. Residence time of the acidified starch slurry in liquefier 14 to effect partial hydrolysis and sterilization of the starch can vary from about 1 second to about 15 minutes and preferably from 1 second to about 1 minute.

It is further within the scope of this invention to employ a liquefying enzyme, e.g., alpha-amylase, for the liquefaction step thereby dispensing with an acid neutralization procedure prior to the use of the product sugar liquor in ethanol fermentation. The starch slurry passing through line 12 is combined with from about 0.3 to about 3.0 lb. per 1000 lb. of dry starch, and preferably from about 0.5 to about 1.0 lb. per 1000 lb. of dry starch, of liquefying enzyme delivered from storage vessel 18 by pump 19 through line 20. Starch liquefier 14 is advantageously maintained at a temperature of from about 160° F. to about 250° F., and preferably at from about 200° F. to about 230° F. In order to optimize the hydrolyzing activity of the enzyme, it is preferred to adjust the pH of the starch slurry, either before, with or following the addition of the liquefying enzyme, but before significant liquefaction has occurred, to a pH level of from about 3.0 to about 6.0, and preferably from about 4.0 to about 5.0, advantageously employing any of the aforementioned strong acids.

Emerging from liquefier 14, the liquefied starch is conveyed to saccharifying vessel 21 containing an acidic cationic exchange resin for catalyzing the further hydrolysis of the starch to fermentable sugar. In the event enzyme is employed in the liquefying operation, the cation exchange resin can also be used for recovery the enzyme as described in U.S. Pat. No. 3,969,538, the disclosure of which is incorporated by reference herein. As a class, the acidic cationic exchange resins are high molecular weight polyacids which are virtually insoluble in and inert to the liquefied starch. They preferably consist of a three-dimensional hydrocarbon network to which are attached the acid groups which act as the ion exchangers. The cation exchangers can contain sulfonic, phosphoric, phosphonous, arsenic and like acid groups. Strongly acidic cation exchangers such as sulfonated cross-linked polystyrene are especially advantageous. Examples of these cationic exchangers are Amberlite IR-120 and Amberlyst 15 produced by Rohm and Haas Company, Chempro-20 and Duolite C-25 of Chemical Process Company, Dowex 50 of Dow Chemical Company, Nalcite HCR of National Aluminate Corporation and Permutit Q of Permutit Company. Sulfonated phenol-aldehyde condensation products are another form of suitable cation exchange resin which can be used in the process of the invention. The sulfonic acid group in these resins can be on a side chain, as in a $—CH_2SO_3H$ group, or attached directly to the aromatic nucleus. The first named type is made, for example, by heating together phenol, formaldehyde and a mixture of sodium sulfite and sodium metabisulfite and then adding additional phenol and formaldehyde and heating to gelation, or is made by introducing the sulfonic groups into a preformed phenol-formaldehyde condensate. The second type can be prepared by reacting a paraphenol sulfonic acid with formaldehyde and phenol and heating the resin in drying pans to remove the excess water and form cross linkages. The resin has both $—SO_3H$ and —OH groups attached to the aromatic ring The amount of cationic exchange resin employed in saccharifying vessel 21 is not a critical factor but ordinarily will be an amount which is required to achieve a predetermined level of fermentable sugar for a given residency time of the liquefied starch. Thus, for example, for a residency time of from about 1 to about 30 minutes after which time at least about 60 weight percent and preferably at least 80 weight percent of the original starch will have been converted to fermentable sugar, an amount of cationic exchange resin occupying from about 40% to about 90%, and preferably from about 60% to about 80% of the volume of saccharifying vessel 21, can be used. Following saccharification, the sterile sugar liquor is conveyed through line 22 to flash tank 23 where steam is flashed through line 24 to adiabatically cool the liquid mass, preferably to about 212° F. Alternatively, the vapors are passed through line 25 to direct contact water jet condenser 26 supplied with cold water through line 27 with the liquid condensate passing through line 28 to a sump sewer. When any acid has been used herein, either for accomplishing initial hydrolysis or for optimizing enzyme activity, it is necessary to add a neutralizing agent to the sugar liquor in at least a stoichiometric amount prior to subjecting the sugar to fermentation. Advantageously the acid is neutralized with ammonia conveyed from storage vessel 29 by pump 30 through line 31. The ammonium nitrate, sulfate, chloride and/or phosphate which is produced by neutralization of the acid is retained in the product fermentable sugar produced by the process herein and satisfies a nutritional need of the yeast used in the conversion of the sugar to ethanol. The neutralized sugar liquor passing through line 32 is delivered by pump 33 through line 34 to storage vessel 35 (or, if desired, directly to a fermentation unit).

In a further embodiment of the present invention, stillage bottoms from a distillation unit such as described in U.S. Patent application Ser. No. 043,189, filed May 29, 1979 containing unfermentable sugar repolymerizates and/or isomers can be subjected to acid cationic exchange resin hydrolysis to convert said repolymerizates and/or isomers to fermentable sugars.

If a starch slurry is employed in the foregoing process which contains insoluble matter, such matter should be separated from the product sugar prior to the use of the latter in fermentation in order to prevent the accumulation of such matter in the fermentation vessel(s). The separation can be readily accomplished employing any of the known and conventional techniques such as filtration, centrifugation, etc. Sugar liquor in storage vessel 35 can be conveyed by pump 36 through line 37 to a fermentation unit as needed.

Fermentation of the sugar liquid herein to provide ethanol is advantageously carried out by the fermentation process disclosed in commonly assigned copending U.S. patent application Ser. No. 043,190, filed May 29, 1979.

What is claimed is:

1. A process for the hydrolysis of starch to provide an aqueous solution of fermentable sugar which comprises:

(a) liquefying an aqueous slurry of starch in the presence of a liquefying agent selected from the group consisting of strong acid and liquefying enzyme to provide sterile liquefied starch; and, (b) saccharifying the liquefied starch in the presence of a catalytically effective amount of an acidic cationic exchange resin.

2. The process of claim 1 wherein the starch is derived from cassava, taro, soughum, wheat, potatoes, rice, or milo.

3. The process of claim 1 wherein the starch contains water soluble protein, fat, sugar, vitamins, and/or minerals.

4. The process of claim 1 wherein the starch contains water insoluble components which are removed prior to the consumption of the saccharified starch.

5. The process of claim 1 wherein strong acid is used to achieve liquefaction.

6. The process of claim 5 wherein the strong acid is at least one member of the group consisting of nitric acid, sulfuric acid, hydrochloric acid and phosphoric acid.

7. The process of claim 6 wherein ammonia or aqueous ammonia is added to the liquefiled starch to at least partially neutralize the acid and form at least one salt selected from the group consisting of ammonium nitrate, ammonium sulfate, ammonium chloride and ammonium phosphate.

8. The process of claim 1 wherein liquefying enzyme is used to achieve liquefaction.

9. The process of claim 8 wherein the pH of the aqueous starch slurry is adjusted to from about 3.0 to about 6.0 prior to, with, or following the addition of liquefying enzyme but before significant liquefaction has occurred.

10. The process of claim 8 wherein the pH of the aqueous starch slurry is adjusted to from about 4.0 to about 5.0 prior to, with, or following the addition of liquefying enzyme but before signficant liquefaction has occurred.

11. The process of claim 9 wherein the pH is adjusted by use of a strong acid.

12. The process of claim 11 wherein the strong acid is selected from the group consisting of nitric acid, sulfuric acid, hydrochloric acid and phosphoric acid.

13. The process of claim 8 wherein the liquefying enzyme is alpha-amylase.

14. The process of claim 1 wherein the acid cationic exchange resin possesses a three dimensional hydrocarbon network to which are attached acid groups.

15. The process of claim 1 wherein the acid cationic exchange resin contains sulfonic, phosphonic, phosphonous or arsenic acid groups.

16. The process of claim 1 wherein the acid cationic exchange resin is sulfonated cross-linked polystyrene or sulfonated phenol-aldehyde condensation product.

17. The process of claim 1 wherein stillage bottoms containing unfermentable sugar repolymerizates and/or isomers are subjected to saccarifying step (b) to convert said repolymerizates and/or isomers to fermentable sugar.

* * * * *